US008894314B2

(12) United States Patent
Morrow et al.

(10) Patent No.: US 8,894,314 B2
(45) Date of Patent: Nov. 25, 2014

(54) TRAVEL DEODORANT DISPENSER

(75) Inventors: Richard P. Morrow, Norwalk, CT (US); Patrick Birde, Bridgeport, CT (US)

(73) Assignee: Richard P. Morrow, Norwalk, CT (US)

( * ) Notice: Subject to any disclaimer, the term of this patent is extended or adjusted under 35 U.S.C. 154(b) by 0 days.

(21) Appl. No.: 13/427,854

(22) Filed: Mar. 22, 2012

(65) Prior Publication Data

US 2013/0251436 A1 Sep. 26, 2013

(51) Int. Cl.
*A45D 40/00* (2006.01)
*A45D 34/00* (2006.01)
*A45D 40/26* (2006.01)

(52) U.S. Cl.
CPC ..... *A45D 34/00* (2013.01); *A45D 40/26* (2013.01); *A45D 2040/0012* (2013.01)
USPC ..... 401/261; 401/8; 401/54; 15/227; 132/320

(58) Field of Classification Search
CPC ..... A45D 2040/0012
USPC ..... 401/8, 54, 261, 266
See application file for complete search history.

(56) References Cited

U.S. PATENT DOCUMENTS

| | | | | | |
|---|---|---|---|---|---|
| 2,664,581 | A * | 1/1954 | Miller et al. | ..... | 132/307 |
| 4,014,616 | A * | 3/1977 | Mast et al. | ..... | 401/292 |
| 4,893,956 | A * | 1/1990 | Wojcik et al. | ..... | 401/130 |
| 4,994,049 | A * | 2/1991 | Latzke et al. | ..... | 604/307 |
| 5,000,356 | A * | 3/1991 | Johnson et al. | ..... | 222/391 |
| 5,771,522 | A * | 6/1998 | Carmody | ..... | 15/208 |
| 6,196,747 | B1 * | 3/2001 | Kreiseder et al. | ..... | 401/266 |
| 6,406,206 | B1 * | 6/2002 | Girardot et al. | ..... | 401/264 |
| 6,528,154 | B1 * | 3/2003 | Yamato | ..... | 428/317.9 |
| 7,416,358 | B2 * | 8/2008 | Legendre | ..... | 401/205 |
| 7,674,058 | B2 * | 3/2010 | Berger Sharp et al. | ..... | 401/7 |
| 7,927,034 | B2 * | 4/2011 | Staniforth et al. | ..... | 401/262 |
| 8,272,801 | B2 * | 9/2012 | Linzell | ..... | 401/261 |
| 8,393,043 | B2 * | 3/2013 | Limongi et al. | ..... | 15/209.1 |
| 2001/0048841 | A1 * | 12/2001 | Girardot et al. | ..... | 401/266 |
| 2003/0095827 | A1 * | 5/2003 | Ruschke et al. | ..... | 401/266 |
| 2008/0004648 | A1 * | 1/2008 | Hohlbein et al. | ..... | 606/161 |
| 2012/0128399 | A1 * | 5/2012 | Limongi et al. | ..... | 401/8 |

* cited by examiner

*Primary Examiner* — David Walczak
*Assistant Examiner* — Joshua Wiljanen
(74) *Attorney, Agent, or Firm* — Handal & Morofsky LLC

(57) ABSTRACT

A device for the application of a gel or solid substance to a human body surface is disclosed. The apparatus is comprised of an applicator portion to which gel or solid deodorant is secured and which is coupled to a handle portion. The applicator portion is sized to accommodate a single application of deodorant in a compact format while the handle portion is sized to be grasped between the fingers and thumb of the human hand. The handle portion comprises a moveable connecting point allowing the handle portion to traverse between a storage position and a gripping position during use.

21 Claims, 13 Drawing Sheets

TRAVEL DEODORANT DISPENSER

TECHNICAL FIELD

The invention relates to apparatus and methods for the delivery of deodorant to the surface of the skin of a human user.

CROSS REFERENCE TO RELATED APPLICATIONS (Not applicable)

STATEMENT REGARDING FEDERALLY SPONSORED RESEARCH OR DEVELOPMENT (Not applicable)

BACKGROUND OF THE INVENTION

Today, people are exceedingly busy in attending to business matters and often have to rush between multiple appointments. Often, this does not leave much time for the luxury of returning home to freshen up. Accordingly, such products are of increasing importance.

Additionally, a high-paced, mobile lifestyle, involving such things as airline flights, road trips and the like, does not lend itself well to carrying large hygiene product containers, such as a conventional deodorant product, which can open, and under certain circumstances, spill while they are inside bags and briefcases. Therefore, a need exists for a small, single use deodorant applicator which can be easily concealed, even in a small pocket, yet safe for transport due to an individually sealed, portable design.

SUMMARY OF THE INVENTION

In accordance with the invention, an apparatus for the delivery of deodorant to the surface of the human body is provided. It comprises an applicator portion to which is secured a gel or solid deodorant and which is coupled to a handle portion. The applicator portion is sized to accommodate a single application of deodorant in a compact format while the handle portion is sized to be grasped between the fingers and thumb of a human hand. The handle portion comprises a flexible connecting point allowing the handle portion to traverse between a storage position and a gripping position during use.

The invention comprises an apparatus for the application of a gel or solid deodorant substance to the surface of a human body. In accordance with the invention, a base comprises an applicator portion. The applicator portion has a deodorant support side, a gripping portion, and a deodorant substance secured to the applicator portion of the base. The base and deodorant substance form the applicator and an enclosure defining a compartment houses the base and the deodorant substance.

The applicator portion of the base comprises a matrix of recesses to which the deodorant substance is affixed. The matrix of recesses defines an array of narrow elongated contours at least some of which extend at least partially around one or more of others of the narrow elongated contours. Each of the narrow elongated contours defines a recess defined by facing sidewalls which extend at an angle with respect to the deodorant support side and face the sidewalls engaging the deodorant substance. The handle is coupled to the gripping portion of the base. The enclosure comprises a plastic film.

The handle comprises a rigid grip dimensioned to be grasped between the fingers and thumb of a human hand. A mounting member coupled to the base and rotatably supporting the rigid grip enables the rigid grip to move between a storage position and a gripping position. The mounting member of the apparatus is mounted on the base by mounting pins allowing the flexible mounting member to rotate around the mounting pins in an arc.

The handle of the apparatus may comprise a cloth member comprising a gripping end protruding from the gripping portion of the base and dimensioned to be grasped between the fingers and thumb of a human hand and a mounting end coupled to the gripping portion of the base.

The handle may also comprise two gripping members protruding from the base. The gripping members define a finger hole passing through the gripping member. The hole is sized to allow a finger or thumb of a human hand to be inserted within the finger hole. The gripping members comprise a flexible mounting member coupled to the base which allow the gripping members to traverse between a storage position and a gripping position. The base and handle are made of plastic injection molded from a single piece of plastic.

BRIEF DESCRIPTION THE DRAWINGS

The operation of the invention will become apparent from the following description taken in conjunction with the drawings, in which:

FIG. 1*a* is a side view outlining the basic elements of the invention in which the applicator portion and handle portion may be understood;

FIG. 1*b* is a cross-sectional view of the support base and supported deodorant material along lines 1*b*-1*b* of FIG. 3 corresponding to a cross-sectional view defined by the intersection of a plane perpendicular to the plane roughly defined by the support and a plane perpendicular to and passing through the center of the support;

DETAILED DESCRIPTION OF THE PREFERRED EMBODIMENTS

Figure 1A:
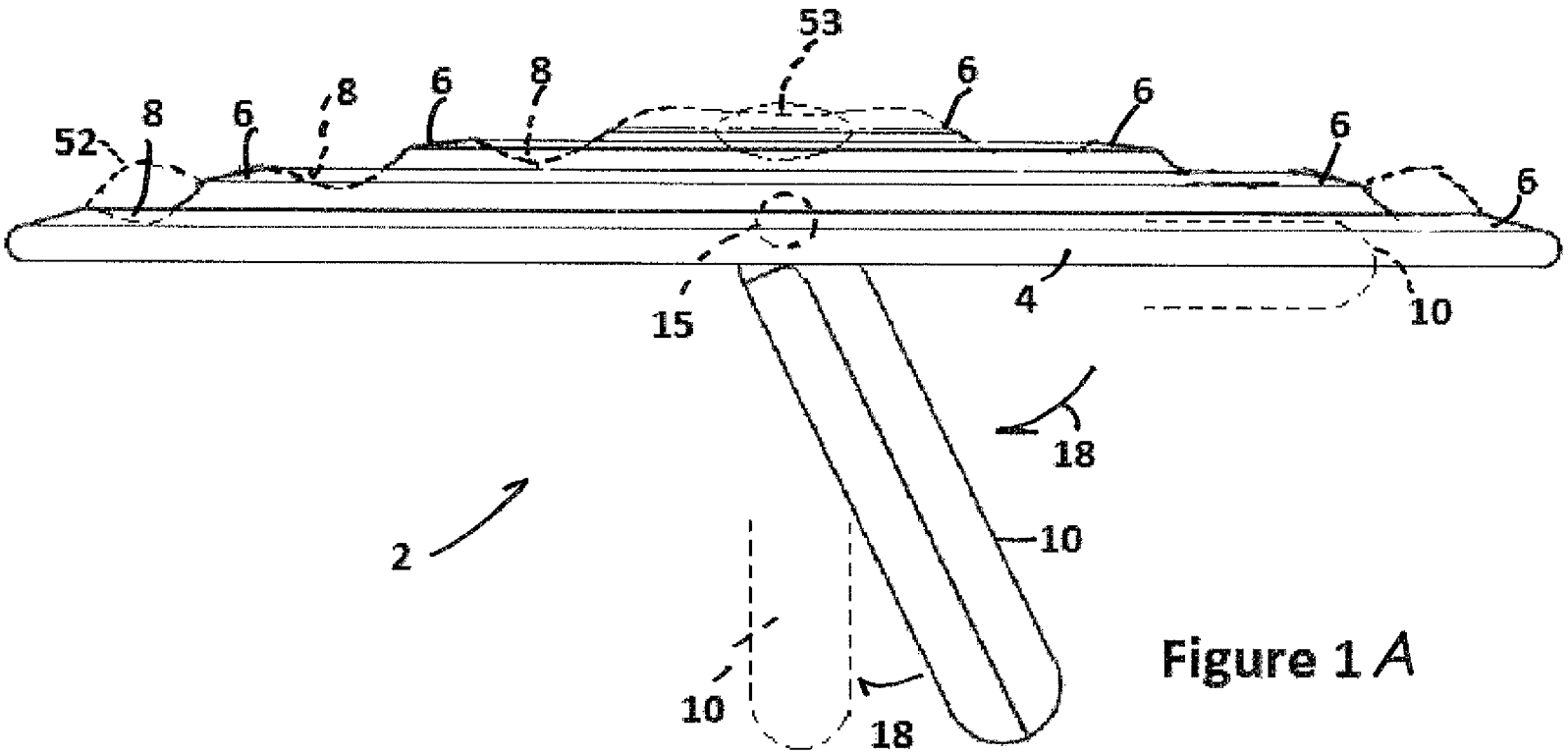

Referring to FIG. 1*a*, an overview of a single-use deodorant applicator may be understood. The single-use deodorant applicator 2 comprises a circular base 4 composed of plastic in accordance with a preferred embodiment, or, alternatively, metal. Base 4 is rigid and functions as a foundation upon which the rest of the device is constructed. The top of circular base 4 comprises a series of raised rings 6 as well as corresponding circular channels 8. Raised rings 6 and circular channels 8 are shaped and spaced in such a way that deodorant, in either gel or solid form, can be affixed to base 4 with the deodorant utilizing raised rings 6 and circular channels 8 as an adherence surface. A plastic or metal handle 10 is coupled to the underside of base 4 such that handle 10 can swivel out from a position lying flat against base 4 (as illustrated in phantom lines), to a position perpendicular or nearly perpendicular to the bottom surface of base 4 for use, or swivel in, parallel to the bottom surface of base 4 for storage.

Figure 1B:
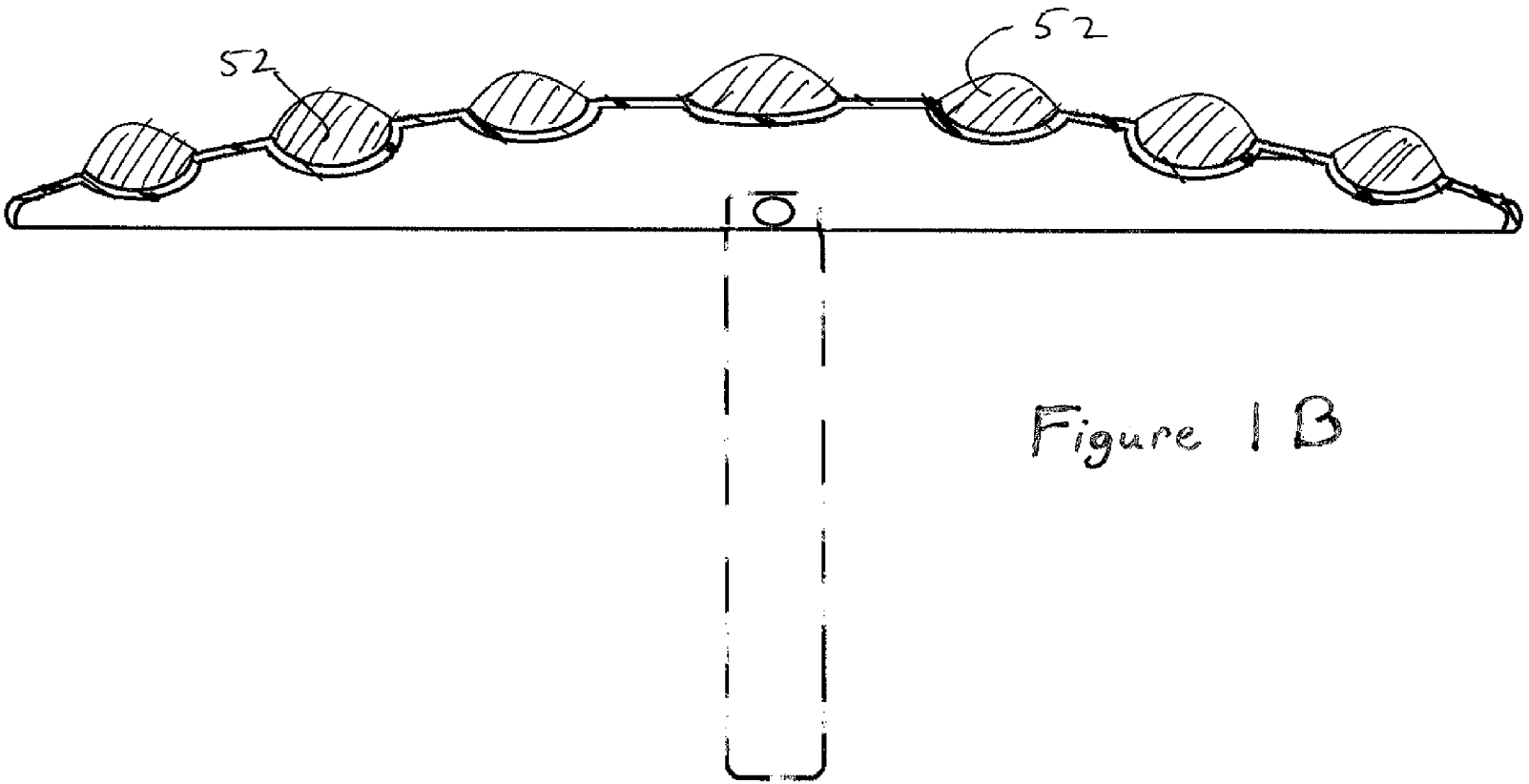

FIG. 1 *b* illustrates the placement of deodorant material 52 in channels 8 in the form of rings of deodorant material. It will be understood from the figures that successive rings are positioned at different heights from the bottom of base 4. The outermost rings of deodorant material 52 are relatively low and the central deposition of deodorant material 53 is in the highest position. Accordingly, together rings of deodorant material 52 and the central circular deposition of deodorant material 53 generally defined a convex or domed configuration.

Figure 2:
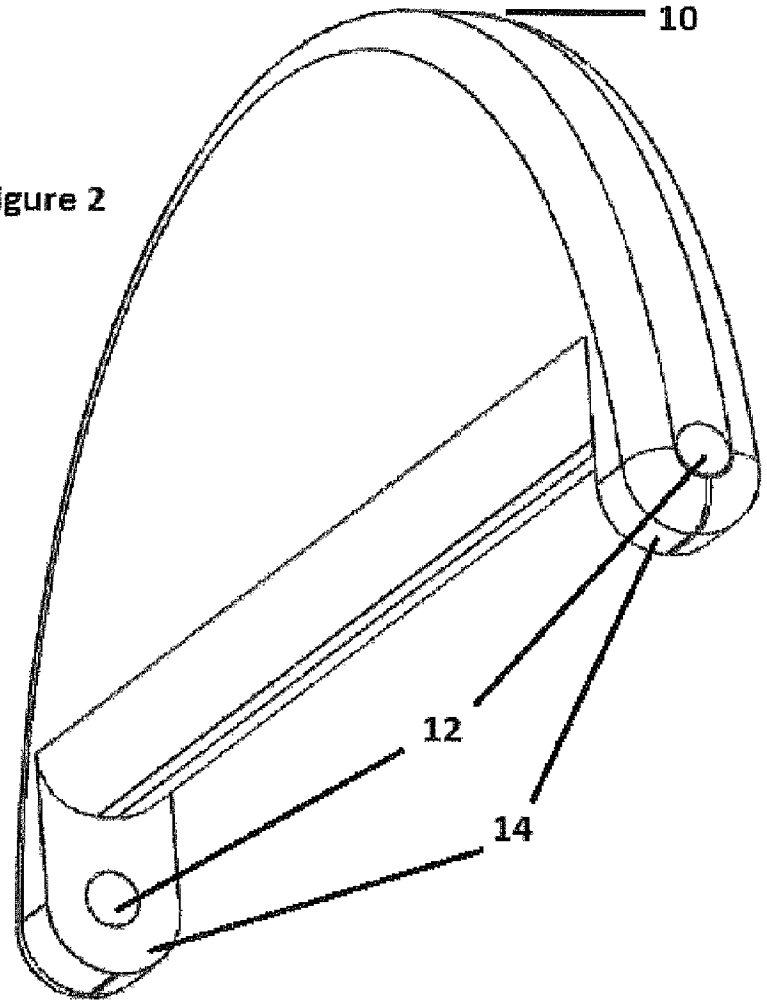
FIG. 2 is a diagram of a rigid handle system embodiment of a handle portion of the invention.

Referring to FIG. 2, the construction of handle 10, and how handle 10 attaches to base 4, may be better understood. Handle 10 is constructed in a semi-circular shape. Handle 10 made sized such that it can fold back against base 4 without protruding. Two mounting holes 12 pass completely through mounting arms 14, which extend past base 4 on either side of the attaching end of handle 10. The mounting arms 14 and handle 10 are formed in a single injection molded plastic member, adding strength and simplicity to the design. The mounting holes 12 allow the handle 10 to be attached to base 4 of the single-use deodorant applicator through the use of mounting pins 15 (FIG. 1 *b*), which will be described in greater detail below.

Figure 3:
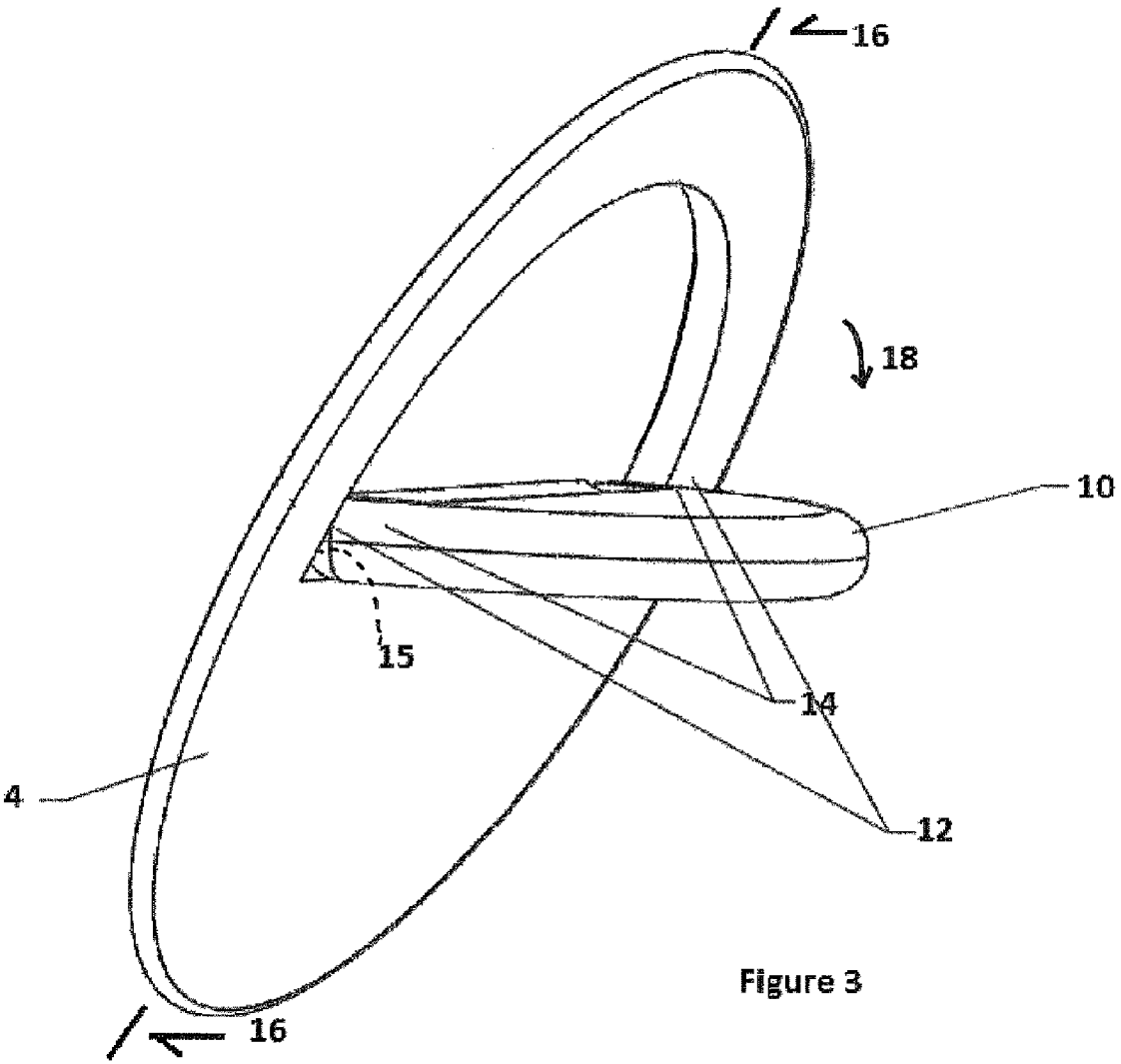
FIG. 3 is a diagram of a coupling system comprising a rigid handle system and the base of the applicator portion of the invention.

Referring to FIG. 3, a connection assembly attaching handle 10 to base 4 may be understood in greater detail. The handle 10 connects to base 4 such that handle 10 can be quickly snapped into place during component assembly. The component assembly process involves aligning mounting arms 14 of handle 10 perpendicular to the bottom of base 4 such that mounting holes 12 of mounting arms 14 are positioned just below a pair of mounting pins 15 protruding from base 4. The mounting pins 16 protrude from base 4 such that they are always in line with holes 12 in mounting arms 14, when properly mounted inside mounting holes 12. The mounting pins 15 are positioned such that it is possible for handle 10 to traverse a semi-circular arc defined in the direction of arrows 18, thus allowing the orientation of handle 10 to traverse such arc from a flat starting position against the bottom of base 4 to a finishing position which is perpendicular to the bottom of base 4. Deodorant material 52 of conventional design is deposited in circular channels 8.

Figure 4:
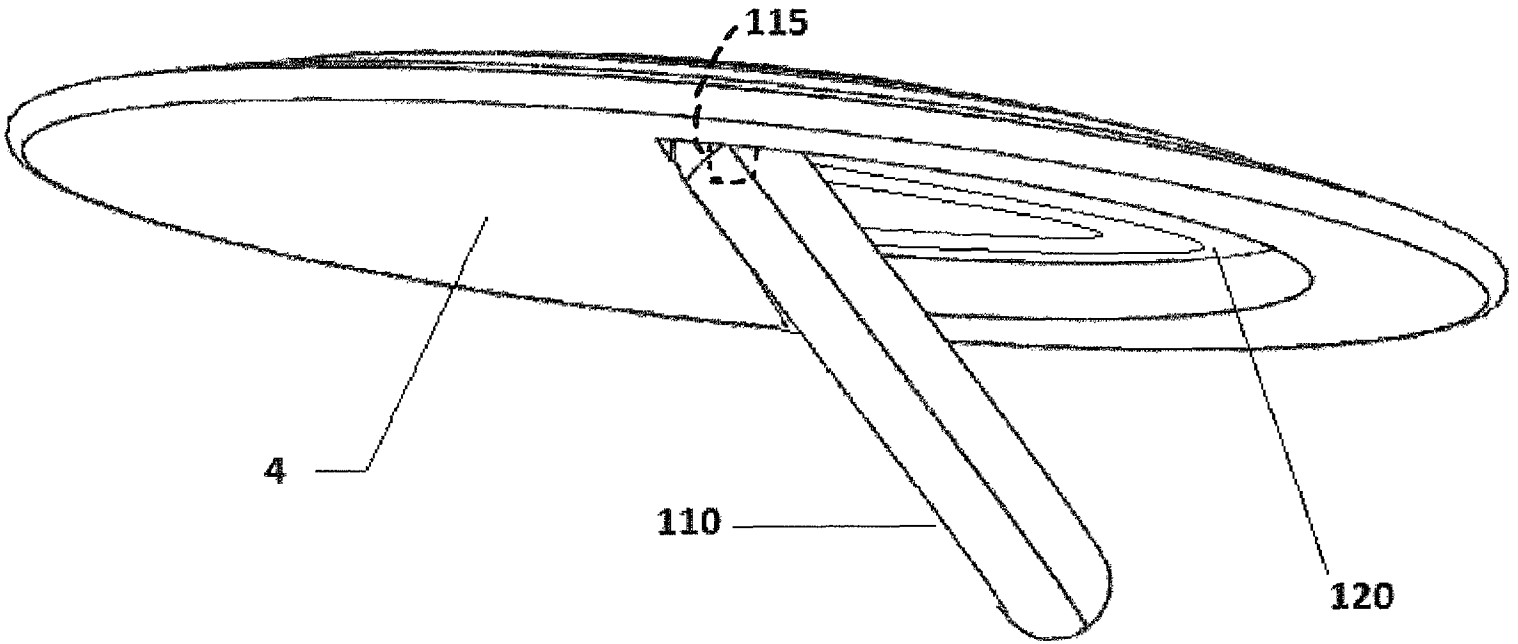
FIG. 4 is a diagram of an alternate mounting method of a rigid handle system coupled to the base of the applicator portion of the invention.

Referring to FIG. 4, an alternate mounting method for handle 110 may be understood. Once again, handle 10 is attached to base 4 through the connection of mounting pins 16 in mounting holes 12 which are located at the ends of mounting arms 14. The handle 10 is mounted such that mounting arms 14 are always perpendicular to mounting pins 115, thus allowing the orientation of handle 110 to traverse in an arc from a flat position against base 4 to an extended position which is perpendicular to base 4. The mounting pins 115 are coupled to base 4 and are located inside a recess 20 on the bottom of base 4, thus allowing handle 10 to fold inside base 4 for compact storage with minimal or no protrusion from base 4. The recess 120 is shaped to match the shape of handle 10 such that handle 10 fits snugly inside recess 120 without sticking such that handle 10 may be easily extended along the arc defined by the movement of handle 10, as it may be moved by the use of, for example, a human finger.

Figure 5:
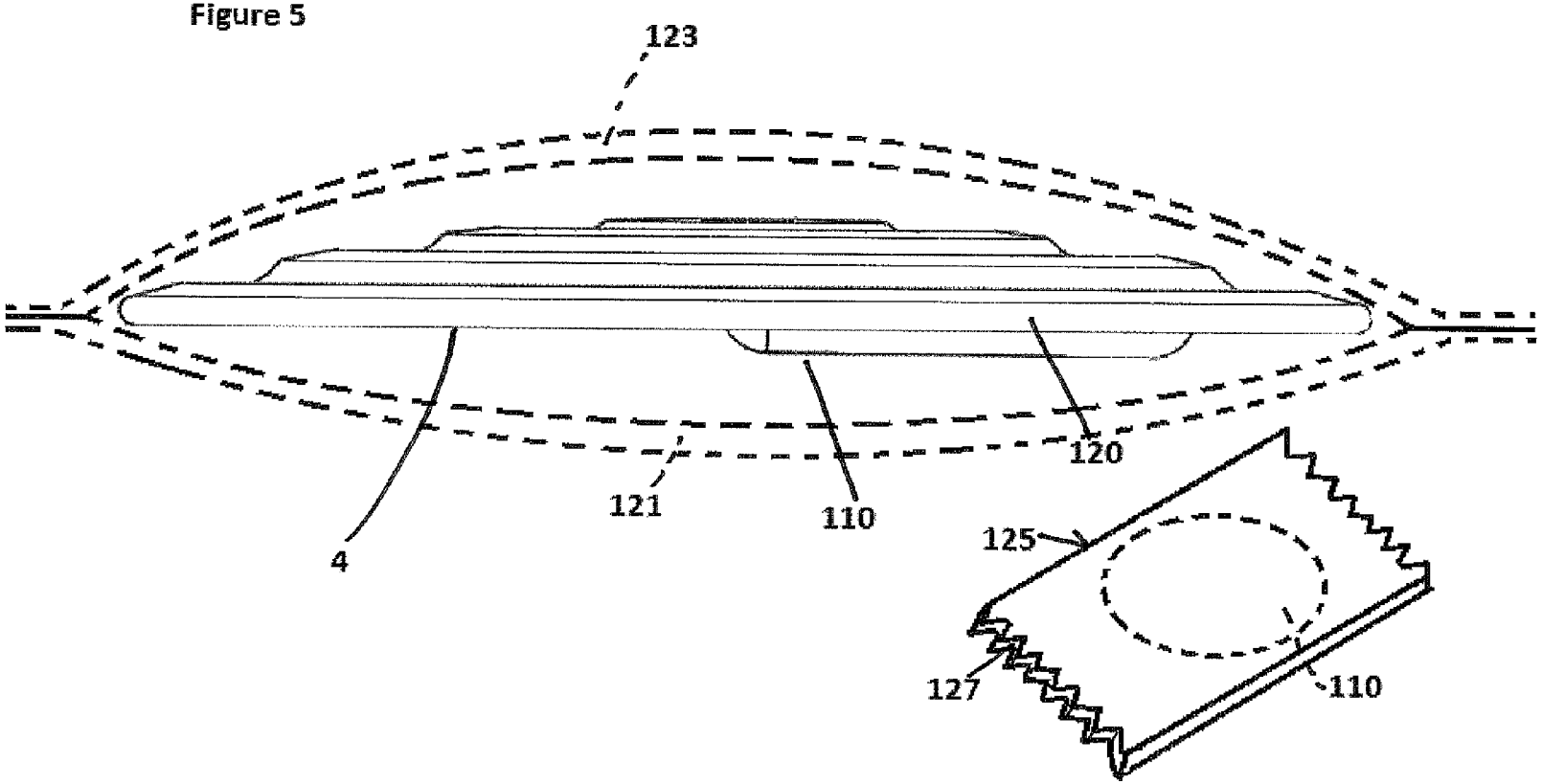
FIG. 5 is a diagram of a possible storage configuration for the invention in which a rigid handle system is stowed into a recess in the underside of the base of the applicator portion of the invention.

Referring to FIG. 5, it may be understood how handle 10 fits snugly inside recession 120 of base 4 when handle 10 is in a closed position. In this diagram, it is shown how handle 110 protrudes slightly from recess 20 in the bottom of base 4 such that a finger may make easier contact with handle 110. The configuration diagramed in FIG. 5 allows for a larger contact surface between handle 110 and a human finger while still providing a thin profile for compact storage. If no protrusion is desired, handle 10 they been made thinner.

Also referring to FIG. 5, an optional storage packet may be used to contain the apparatus. Such storage packets may be a conventional form, for example, similar to those used to house condiments such as ketchup and mustard. In accordance with the invention, such a storage packet may be formed in a conventional manner, for example being formed by a pair of facing planar film members. More particularly, a container may be formed by a planar bottom layer 121 and a planar top layer 123. Planar bottom layer 121 and planar top layer 123 may be made of a polymer, such as a simple plastic film as is used to house ketchup. Alternatively, metallized polymer layers may also be employed. In accordance with the invention, it is contemplated that planar bottom layer 121 and planar top layer 123 would have a thickness in the range of 2-7 thousandths of an inch.

In the case of a simple polymer layer of the type used to house ketchup in individual single servings, planar bottom layer 121 and a planar top layer 123 may be formed into a packet by being heat-sealed around their edges 125 (FIG. 5*a*). As is apparent from the figures, planar bottom layer 121 and planar top layer 123 are substantially the same size and larger than the inventive applicator 110. Accordingly, planar bottom layer 121 and planar top layer 123 extend beyond the edge of both the length and width of the applicator 110. The peripheral portions of planar bottom layer 121 and a planar top layer 123 are fused together, for example, using heat around the edge of the apparatus to form an airtight, single-use container similar to a ketchup packet. The result is a sealed unit 125 containing applicator 110. Sealed unit 125 includes serrations 127 in a manner typical of such packets.

It is noted that while the use of such a package is illustrated only in FIG. 5, it may be understood this packet can be used to house any of the other variations of the inventive apparatus as illustrated in the figures herein.

In accordance with the invention, it is contemplated that a plurality of applicators 110 would be contained each in its own container 123, perhaps packaged in a larger box containing a half-dozen or several dozen packaged applicators. When it is desired to use one of these devices to apply deodorant, the package is split between the serrations 127 using the fingernails, torn open and the deodorant applicator 110 is removed and used as described herein.

Figure 6:
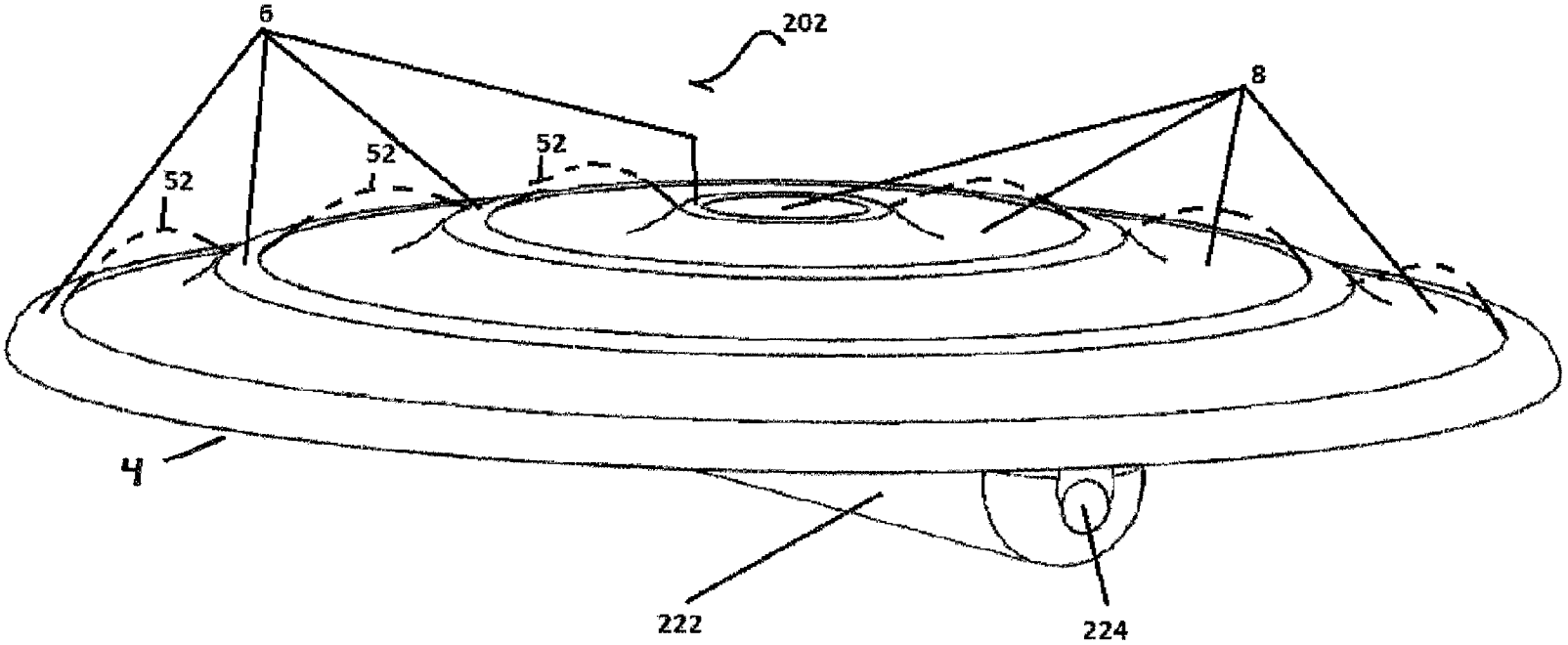
FIG. 6 is a diagram of an alternate mounting configuration for a handle portion of the invention.

Referring to FIG. 6, an alternate mounting configuration for handle 10 may be understood. A cylindrical mounting protrusion 222 extends from the bottom of base 4 such that it is possible to align mounting holes 12 of mounting arms 14 with mounting pin 224 of mounting protrusion 222. The mounting pin 224 along the length of mounting protrusion 222, perpendicular to the circular faces of the cylinder and, therefore, parallel to the bottom of the base 4. When the mounting holes 12 of the mounting arms 14 are properly aligned with the mounting hole 14 of the mounting protrusion 222, handle 10 rotates on pins 224 Thus, handle 10 may easily be snapped into place, similar to the process described with respect to FIG. 3, and may further rotate freely after being snapped into place.

Also referring to FIG. 6, the circular ring system of ridges and channels involved in the mounting of gel or solid deodorant may be understood. The raised rings 6 and circular channels 8 are all formed from the same plastic member that comprises base 4 during the fabrication process of, for example, injection molding. Furthermore, the mounting protrusion 222 can be formed from the same plastic mold as well during the fabrication process with the mounting pin 224 B. As a result of the fabrication process, the raised circular rings 6 and circular channels 8 form a mounting surface for a gel or solid deodorant 52 such that the tops of the channels 8 are nearly slanted extending from but not quite perpendicular to the base 4, thus providing sufficient friction to hold a gel or solid deodorant in place. Because the inner rings 6 and channels 8 protrude higher from the base 4 than the outer rings 6 and channels 8, it is possible for the single-use deodorant applicator 202 to conform to various human body surfaces more easily.

Figure 7:
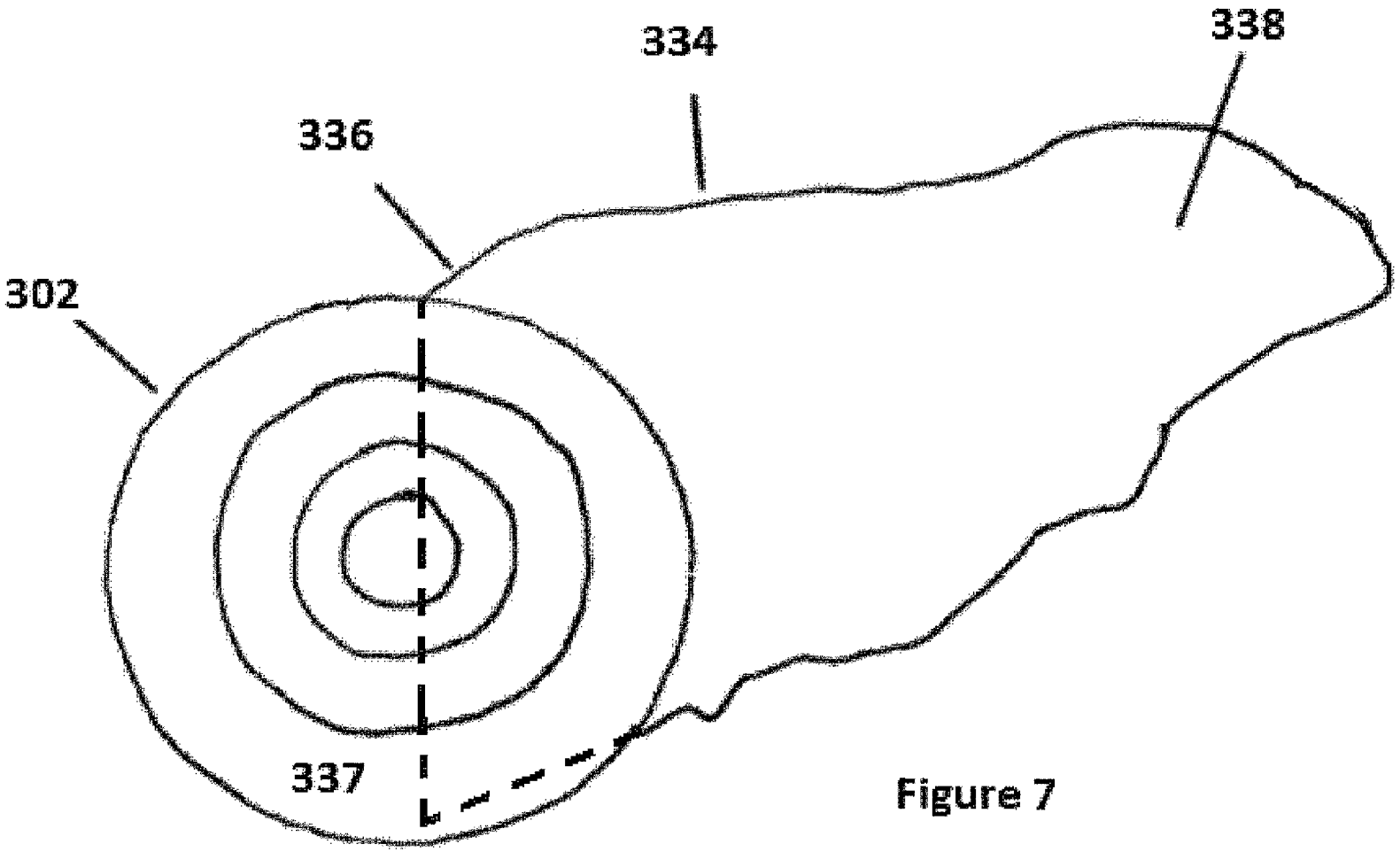
FIG. 7 is a diagram of another alternate cloth handle portion of the invention.

Referring to FIG. 7, an alternate handle system 334 may be understood. In this alternate handle system, a flexible or semi-rigid handle 34 is cut to shape from a sheet of cloth or plastic. The handle 334 comprises an attachment end 336 on one side and a gripping end 338 on the other side. The attachment end 336 is affixed along a joinder line 337 to the bottom of the single-use deodorant applicator 302 using some form of adhesive such as glue or tape. The gripping end 338 protrudes from the side of the single-use deodorant applicator 302 to a sufficient distance such that the gripping end 338 may be easily grasped by the fingers of a human hand. The handle 334 is sufficiently thin to allow for compact packaging. Accordingly handle 334 can be folded behind the single-use deodorant applicator 302 for compact packaging.

Figure 8:
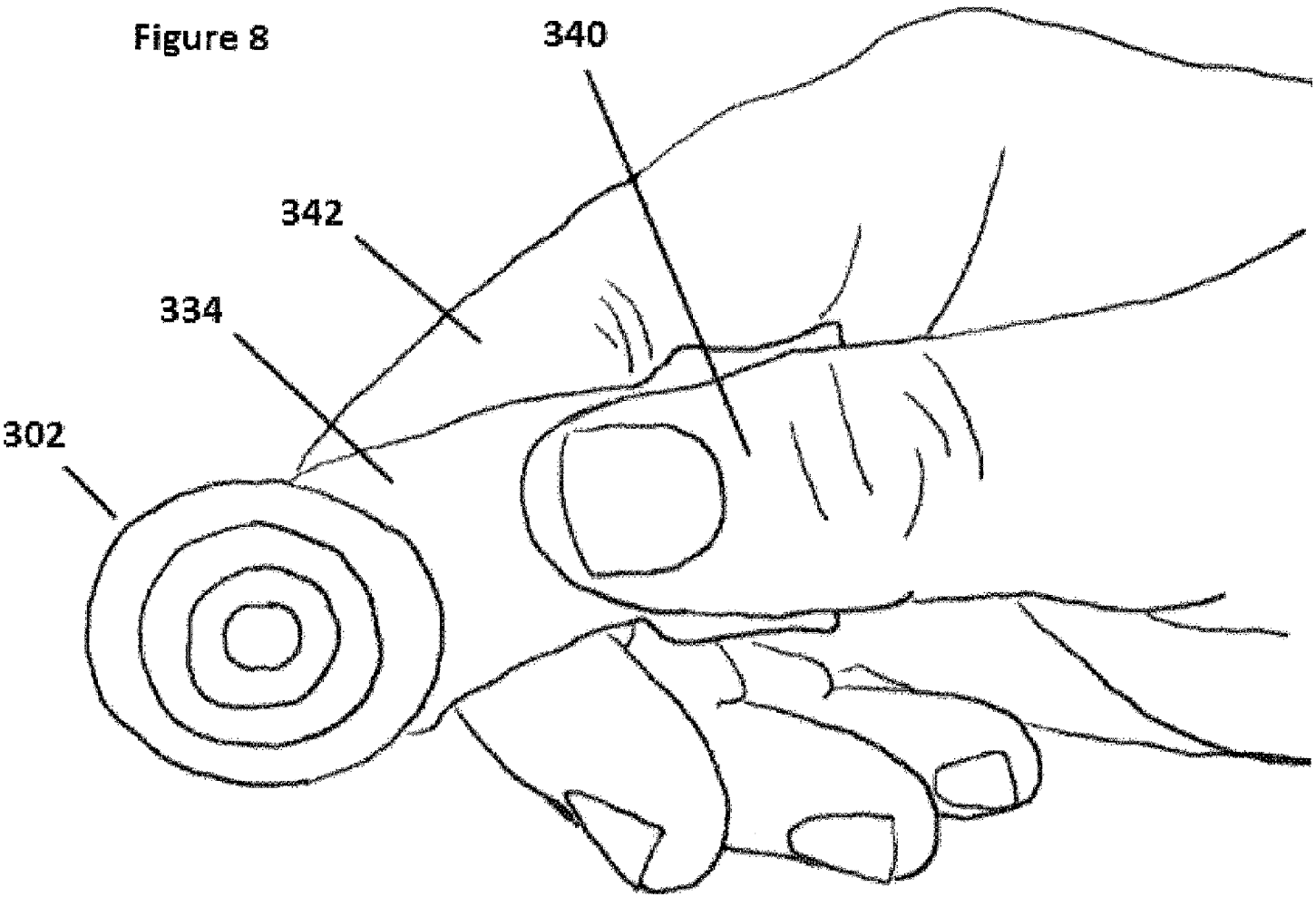
FIG. 8 illustrates the use of the above mentioned alternate cloth handle portion of the invention.

Referring to FIG. 8, the use of the alternate handle system 334 may be understood. As mentioned above, the gripping end 338 of the handle 334 protrudes from the side of the single-use deodorant applicator 302. This allows the fingers of a human hand to easily grasp the handle 334 between them with thumb 340 pressing against the top side of handle 334 and finger 342 pressing against the bottom side of handle 334. This method allows finger 342 to act as a guide for the single-use deodorant applicator 302 while deodorant is being applied to the human body by providing moderate pressure to rub the top surface of the single-use deodorant applicator 302 against the skin surface to which the user wishes to apply deodorant.

Figure 9:
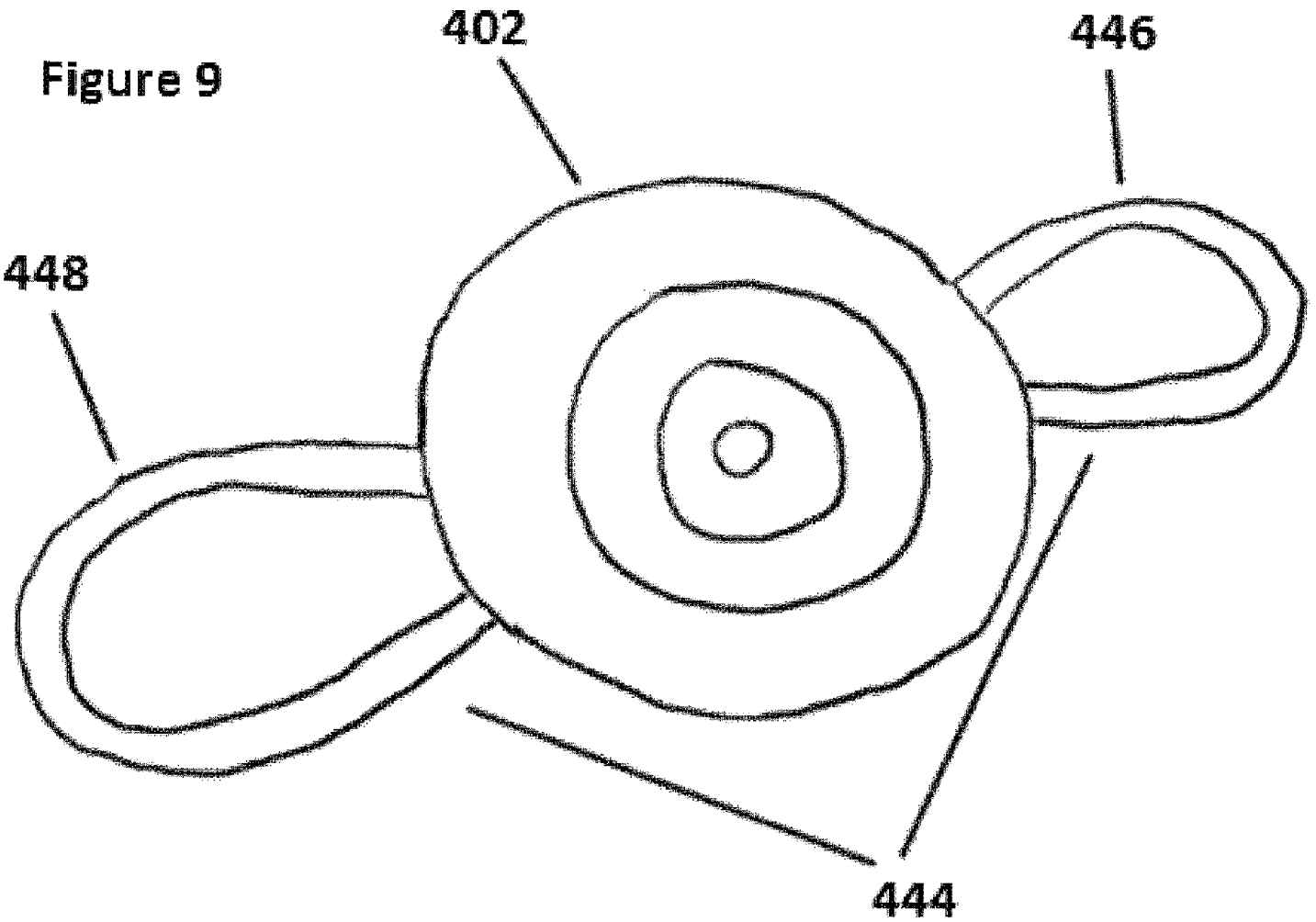
FIG. 9 is a diagram of yet another alternate handle portion comprising a pair of loops.

Referring to FIG. 9, an alternate handle system 444 may be understood. The handle system 444 comprises two plastic loops, loop 446 and loop 448, which are made from the same plastic material of which the single-use deodorant applicator 402 is made. This means that no special attachment system is required. Instead, the handle system 444 is formed at the same time as the single-use deodorant applicator 402 in a single molding or stamping process. This eliminates the need for complicated manual assembly while allowing for many instances of the single-use deodorant applicator 402 to be created simultaneously, in accordance with the manufacturing process to be described below. Loop 446 and loop 448 are flexible enough to be bent backwards below the base of the single-use deodorant applicator 402 for gripping by the thumb and finger of a human hand during use.

Figure 10:
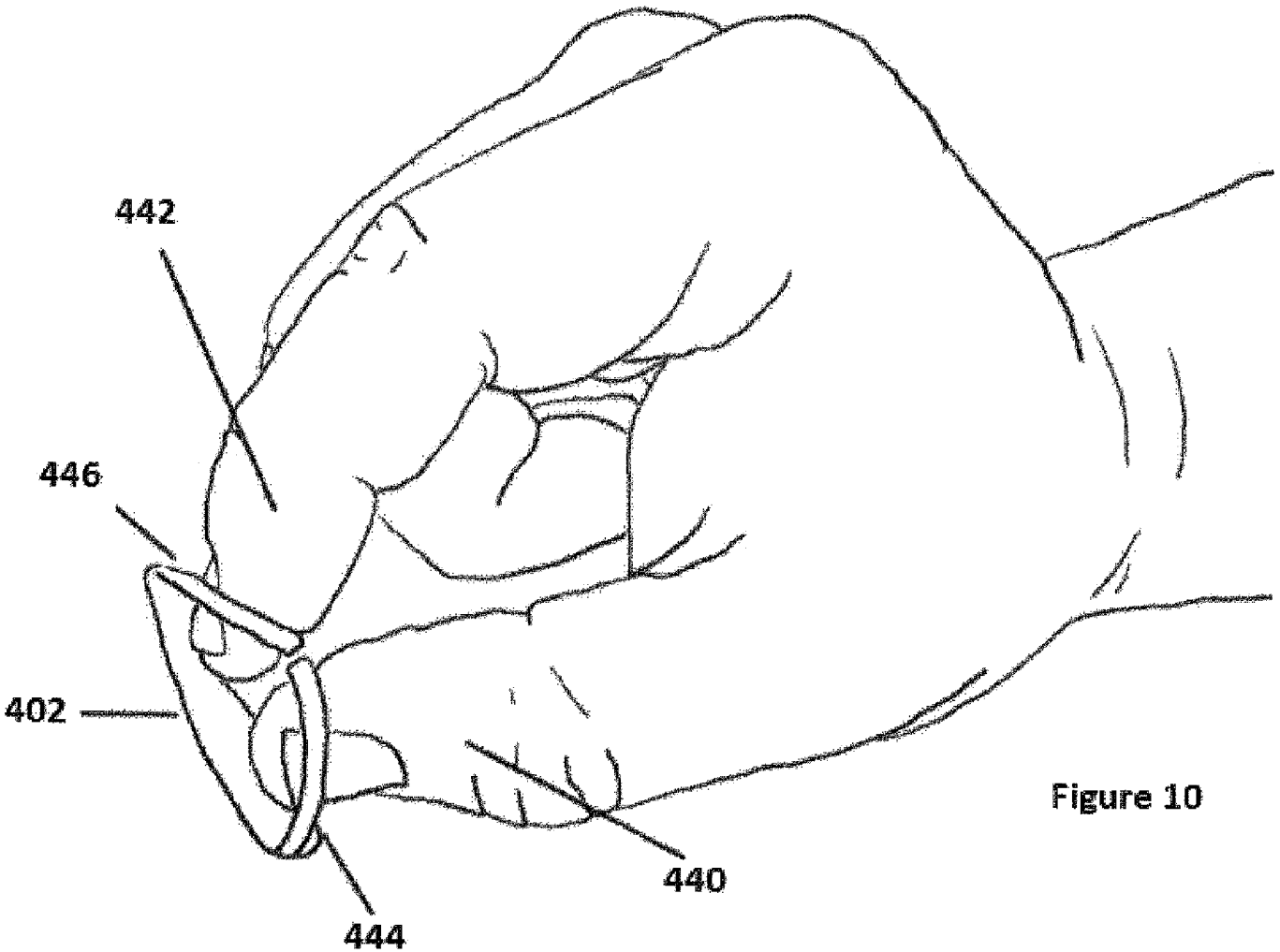
FIG. 10 shows the use of the above mentioned alternate handle portion comprising a pair of loops.

Referring to FIG. 10, the use of the alternate handle system 444 may be understood. The single-use deodorant applicator 402 is gripped by folding loop 446 and loop 448 backwards below the base of the single-use deodorant applicator 402. The thumb 440 is then inserted into the loop 446 while the finger 442 is inserted into the loop 448. The thumb 440 and the finger 442 are then pinched together, thus creating enough tension and friction to hold the single-use deodorant applicator 402 in place and allow for controlled movement during deodorant application to a human body during use.

Figure 11:
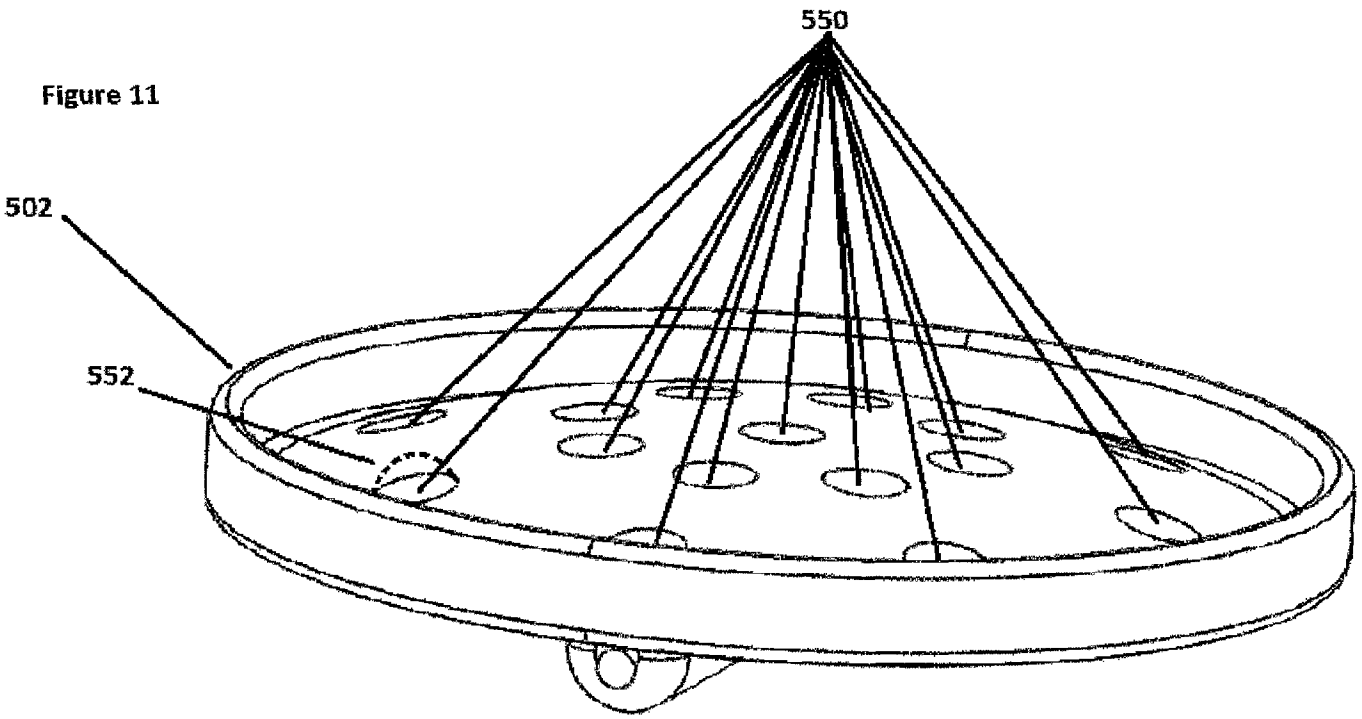
FIG. 11 is a diagram of an array of indentions across the application surface of applicator portion of the invention.

Referring to FIG. 11, a method for securing deodorant in a gel or solid form may be understood. A series of indentations 550 are distributed over the surface area of the single-use deodorant applicator 502 in which deodorant 552 in a gel or solid form may be inserted. The indentations are deep enough to provide a sufficient anchor for the deodorant.

Figure 12:
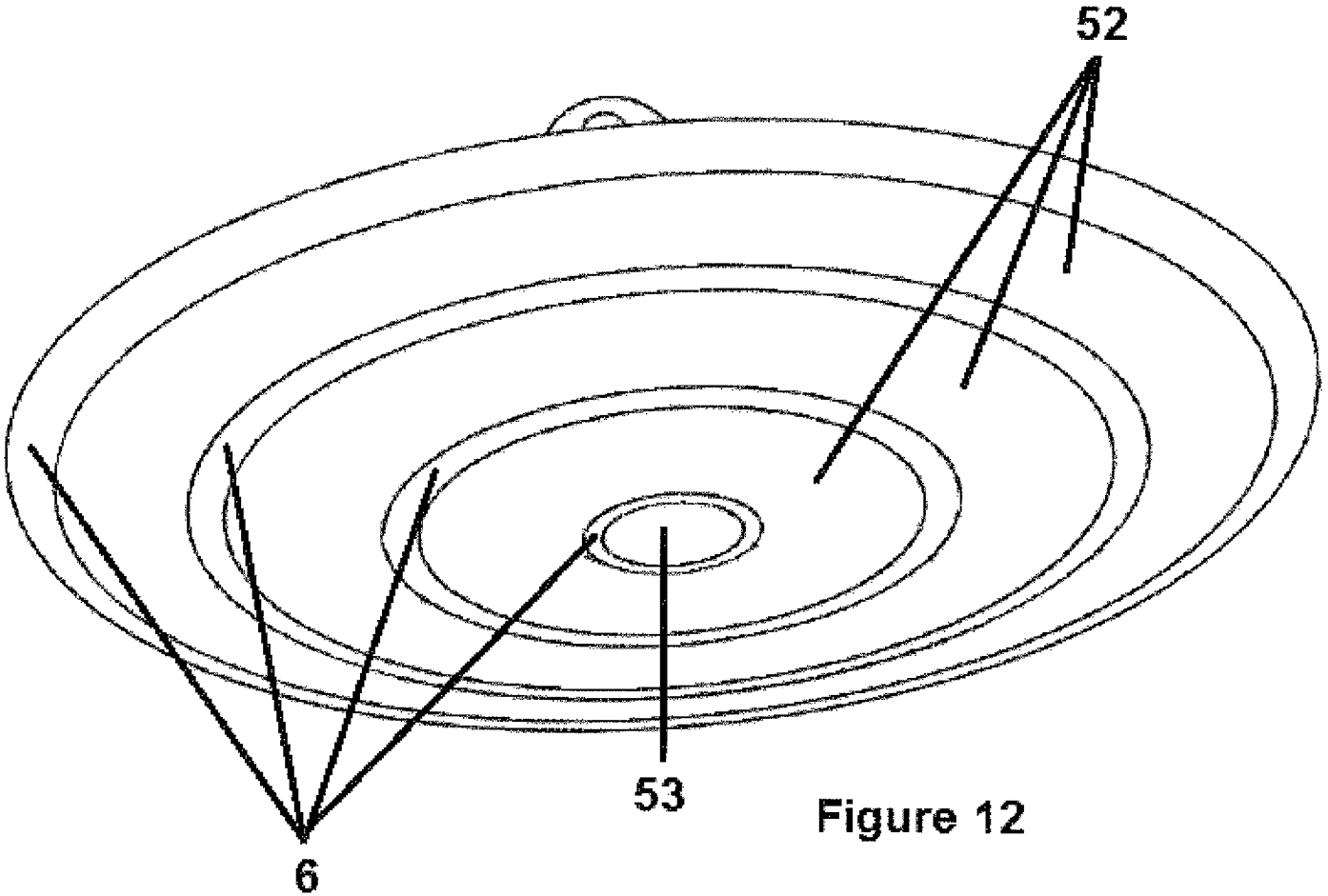
FIG. 12 is a diagram of rings of deodorant anchored between an array of raised rings on the applicator surface of the applicator portion of the invention.

Referring to FIG. 12, the anchoring of a gel or solid deodorant 52 within an array of raised rings 6 may be understood. The deodorant 52 is applied between each of the raised rings 6 such that the deodorant 52 protrudes slightly above the upper surface of the raised rings 6. During the application process, the deodorant 52 will transfer to a contacted human skin surface. Since the human skin surface is flexible, the skin can be pressed in between the raised rings 6, during application, as the vertical height of the deodorant 52 is reduced during use.

The manufacturing of the single-use deodorant applicator 2 is done by injecting plastic into a mold. Alternatively, the desired member may be made by blow performing and die cutting a sheet of plastic. Multiple members may be formed simultaneously across the width of a plastic sheet web in a continuous blow forming process, thus allowing for mass production.

While illustrative embodiments of the invention have been described, it is noted that various modifications will be apparent to those of ordinary skill in the art in view of the above description and drawings. Such modifications are within the scope of the invention which is limited and defined only by the following claims.

What is claimed:

1. Apparatus for the application of an appliable deodorant substance to the surface of the human body comprising:

(a) a base comprising:

(i) an applicator portion having a thickness and a width, said applicator portion having a deodorant support surface, said applicator portion having a thickness substantially smaller than its width, said deodorant support surface defining relatively raised and relatively depressed substantially rigid surfaces; and (ii) a gripping portion;

(b) a deodorant substance secured to the deodorant support surface on said applicator portion of said base, said deodorant being received in at least said relatively depressed surfaces whereby the application of forces roughly parallel to said deodorant support surface causes the exposed outer surface of the deodorant substance to be have its vertical height reduced, but does not substantially displace said deodorant along said support surface at said support surface, said base and deodorant substance forming an applicator; and (c) a protective member, supported over said deodorant substance defining a substantially closed compartment protecting and housing said deodorant substance.

2. Apparatus as in claim 1, wherein said applicator portion of said base comprises a matrix of recesses to which said deodorant substance is affixed.

3. Apparatus as in claim 2, wherein said matrix of recesses defines an array of narrow elongated contours, at least some of said narrow elongated contours extending at least partially around one or more of others of said narrow elongated contours, wherein each of said narrow elongated contours defines a recess defined by facing sidewalls, said facing sidewalls extending at an angle with respect to said deodorant support surface, said facing sidewalls engaging said deodorant substance.

4. Apparatus as in claim 3, wherein said protective member comprises a pair of facing plastic film portions, said facing plastic film portions being secured to each other to form said compartment.

5. Apparatus as in claim 3, wherein said gripping portion comprises:

(a) a handle dimensioned to be grasped between the fingers and thumb of a human hand; and (b) a mounting coupling said handle to said base and hingedly supporting said handle whereby said handle is free to move between a storage position and a gripping position.

6. Apparatus as in claim 5, wherein said mounting is mounted on said base by mounting pins which allow said mounting to rotate around said mounting pins in an arc.

7. Apparatus as in claim 5 wherein said applicator portion and said handle are made of plastic.

8. Apparatus as in claim 7 wherein said applicator portion and said handle are injection molded from a single piece of plastic.

9. Apparatus as in claim 5, wherein said mounting is flexible.

10. Apparatus as in claim 9, wherein said base and said handle are made of plastic.

11. Apparatus as in claim 1, wherein said deodorant substance comprises a gel or solid.

12. Apparatus as in claim 1, wherein said deodorant substance is smearable.

13. Apparatus as in claim 1, wherein said protective member completely surrounds said gripping portion, said applicator portion, and said deodorant substance.

14. Apparatus as in claim 1, wherein said protective member hermetically seals said deodorant substance from the environment.

15. Apparatus as in claim 1, wherein said gripping portion comprises a handle dimensioned to be grasped between the fingers and thumb of a human hand, said handle comprising a mounting portion which allows angular movement of said gripping portion from a first position extending from said applicator portion to a second position adjacent said applicator portion.

16. Apparatus as in claim 15, wherein said mounting structure comprises first and second parts, said first and second parts not being integral with each other.

17. Apparatus as in claim 16, wherein said first part is integral with said applicator portion and said second part is integral with said gripping portion.

18. apparatus as in claim 1, wherein said applicator portion and said gripping portion are formed of a single film-like member.

19. Apparatus for the application of an appliable deodorant substance to the surface of a human body comprising:

(a) a base comprising:

(i) an applicator portion having a thickness and a width, said applicator portion having a deodorant support surface, said applicator portion having a thickness substantially smaller than its width, said deodorant support surface defining relatively raised and relatively depressed substantially rigid surfaces; and (ii) a gripping portion; and (b) a deodorant substance secured to the deodorant support surface on said applicator portion of said base, said deodorant being received in at least said relatively depressed surfaces whereby the application of forces roughly parallel to said deodorant support surface causes the exposed outer surface of the deodorant substance to be have its vertical height reduced, but does not substantially displace said deodorant along said support surface at said support surface, said base and deodorant substance forming an applicator, wherein a matrix of recesses defines an array of narrow elongated contours, at least some of said narrow elongated contours extending at least partially around one or more of others of said narrow elongated contours, wherein each of said narrow elongated contours defines a recess defined by facing sidewalls, said facing sidewalls extending at an angle with respect to said deodorant support surface, said facing sidewalls engaging said deodorant substance.

20. apparatus as in claim 19, wherein said applicator portion and said gripping portion are formed of a single film-like member.

21. Apparatus for the application of an appliable deodorant substance to the surface of the human body comprising:

(a) a base comprising:

(i) an applicator portion having a thickness and a width, said applicator portion having a deodorant support surface, said applicator portion having a thickness substantially smaller than its width, said deodorant support surface defining relatively raised and relatively depressed substantially rigid surfaces; and (ii) a gripping portion, said applicator portion and said gripping portion being formed of a single film-like member; and (b) a deodorant substance secured to the deodorant support surface on said applicator portion of said base, said deodorant being received in at least said relatively depressed surfaces whereby the application of forces roughly parallel to said deodorant support surface causes the exposed outer surface of the deodorant substance to be have its vertical height reduced, but does not substantially displace said deodorant along said support surface at said support surface, and said base and deodorant substance forming an applicator.

* * * * *